US010683647B2

(12) United States Patent
Cullen et al.

(10) Patent No.: US 10,683,647 B2
(45) Date of Patent: Jun. 16, 2020

(54) CATCH BASIN

(71) Applicant: Facility Solutions, Inc., Clinton Township, MI (US)

(72) Inventors: Thomas P. Cullen, Clinton Township, MI (US); Gary R. Niemczyk, Beaverton, MI (US); Justin K. Shaffer, Madison Heights, MI (US)

(73) Assignee: FACILITY SOLUTIONS, INC., Clinton Township, MI (US)

( * ) Notice: Subject to any disclaimer, the term of this patent is extended or adjusted under 35 U.S.C. 154(b) by 0 days.

(21) Appl. No.: 16/233,782

(22) Filed: Dec. 27, 2018

(65) Prior Publication Data

US 2019/0203452 A1 Jul. 4, 2019

Related U.S. Application Data

(60) Provisional application No. 62/611,267, filed on Dec. 28, 2017.

(51) Int. Cl.

| | |
|---|---|
| ***E03C 1/182*** | (2006.01) |
| ***E03C 1/18*** | (2006.01) |
| ***E03C 1/181*** | (2019.01) |

(52) U.S. Cl.

CPC ..... *E03C 1/182* (2013.01); *E03C 1/18* (2013.01); *E03C 1/181* (2013.01)

(58) Field of Classification Search

CPC ..... E03C 1/182
USPC ..... 4/468
See application file for complete search history.

(56) References Cited

U.S. PATENT DOCUMENTS

| | | | | |
|---|---|---|---|---|
| D30,084 | S | 1/1899 | North | |
| 3,713,539 | A | 1/1973 | Thompson et al. | |
| 3,815,625 | A | 6/1974 | Weise | |
| D276,839 | S | 12/1984 | McCoy | |
| 5,032,264 | A | 7/1991 | Geiger | |
| 5,230,188 | A | 7/1993 | Nurse | |
| 6,212,706 | B1 * | 4/2001 | Rossman | A47C 12/02 4/572.1 |
| 6,272,804 | B1 | 8/2001 | Leis | |
| D800,800 | S | 10/2017 | Park et al. | |
| D800,801 | S | 10/2017 | Park et al. | |
| D807,931 | S | 1/2018 | Kim et al. | |
| D809,026 | S | 1/2018 | Harvey et al. | |
| 2003/0146144 | A1 * | 8/2003 | Votel | A47L 17/02 210/232 |
| 2003/0170359 | A1 * | 9/2003 | Garwood | A23B 4/16 426/392 |
| 2007/0177942 | A1 | 8/2007 | Meyers | |
| 2009/0106892 | A1 * | 4/2009 | Hickey | A47K 1/06 4/631 |

(Continued)

*Primary Examiner* — Lori L Baker
(74) *Attorney, Agent, or Firm* — Dinsmore & Shohl LLP

(57) ABSTRACT

Embodiments of the present disclosure are directed to an assembly that drains liquid from kitchen equipment, in particular commercial kitchen equipment, where there otherwise is not a drain. More specifically, the disclosed system provides an assembly that can be mounted near the commercial kitchen equipment to drain liquids, such as water, from the equipment without the need to add in a floor drain. The assembly includes an angled floor within a reservoir to force the liquid through an aperture and a clip assembly so that the reservoir may be mounted directly to or near the kitchen equipment.

20 Claims, 9 Drawing Sheets

(56) References Cited

U.S. PATENT DOCUMENTS

| | | | | |
|---|---|---|---|---|
| 2011/0145988 | A1* | 6/2011 | Le Duff | A47B 77/06 4/630 |
| 2012/0151672 | A1* | 6/2012 | Bucher | A47K 1/04 4/650 |
| 2013/0283521 | A1* | 10/2013 | Jain | E03C 1/18 4/654 |
| 2015/0067962 | A1* | 3/2015 | O'Brien | E03C 1/18 4/630 |

* cited by examiner

CATCH BASIN

CROSS REFERENCE

This application claims priority to the U.S. Provisional Patent Application Ser. No. 62/611,267, filed on Dec. 28, 2017, and entitled "Catch Basin" which is incorporated by reference herein in its entirety under 35 U.S.C. 119(e).

TECHNICAL FIELD

The present disclosure generally relates to commercial kitchen equipment liquid drainage and, more particularly, to systems for draining liquids form commercial kitchen equipment.

BACKGROUND OF THE INVENTION

Commercial kitchen equipment, such as a rethermalizer, are known and used in kitchens to warm or reconstitute food safely. Generally, these types of commercial kitchen equipment, including rethermalizers, must be positioned under an exhaust hood within the kitchen area. Further, these types of commercial equipment require the water to be drained from the equipment to function properly. However, many kitchen floor sinks are not positioned so to function correctly or do not meet local and national code standards mandated by Health and/or Plumbing Departments for drain and air gap requirements.

As a result, many restaurants must excavate the tiled kitchen floor, digging a trench, to relocate the floor sink. This is expensive and time intensive.

SUMMARY

In one embodiment, a catch basin assembly includes a first sidewall and an opposing second sidewall, a first end wall and an opposing second end wall attached to the first and second sidewalls, an angled floor, a bracket, and a clip. The second end wall has an aperture disposed thereon. The angled floor is attached between the first and second sidewalls and the first and second end walls. The angled floor includes a first triangle portion, a second triangle portion, and a third triangle portion. The first triangle portion includes a first base, a first leg and a second leg forming a first apex. The second triangle portion includes a second base, a first adjacent leg and a first hypotenuse forming a second apex. The third triangle portion includes a third base, a second adjacent leg and a second hypotenuse forming a third apex. An uppermost surface of the first, second and third triangle portions attach to the first end wall and a lowermost portion of the angled floor attaches the second end wall such that the angled floor slopes downwardly from the first end wall to the second end wall. A pair of tabs extend from the second end wall in a direction opposite of the first end wall. The bracket slidably engages the pair of tabs and is rearward of the second end wall, the bracket comprises a pair of L-shaped members attached to a rear portion, the L-shaped members slidably engage the pair of tabs. The clip includes an elongated member having a u-shaped slot, the elongated member having a substantially planer surface parallel to a plane of the rear portion of the bracket, the u-shaped slot extends the length of the elongated member and is configured to receive the rear portion of the bracket.

In another embodiment, a catch basin assembly includes a first and second sidewalls, a first and second end walls, and an angled floor. The first and second sidewalls are attached to the angled floor. The first and second end walls are attached to the first and second sidewalls and the angled floor. An aperture disposed in second end wall. The angled floor slopes downwardly from the first end wall to the second end wall such that an upper most portion of the angled floor attaches to the first end wall and a lowermost portion of the angled floor attaches the second end wall and the lowermost portion of the angled floor abuts a lowermost portion of the aperture.

In yet another embodiment, a catch basin assembly includes a first sidewall and an opposing second sidewall, a first end wall and an opposing second end wall attached to the first and second sidewalls, an angled floor, and a screen. The first and second sidewalls are attached to the angled floor. The first and second end walls are attached to the first and second sidewalls and the angled floor. An aperture disposed in second end wall. The first and second sidewalls and the first and second end walls have a planar top surface, the planer top surface is configured to receive the screen. The angled floor includes a first triangle portion, a second triangle portion, and a third triangle portion. The first triangle portion includes a first base, a first leg and a second leg forming a first apex. The second triangle portion includes a second base, a first adjacent leg and a first hypotenuse forming a second apex. The third triangle portion includes a third base, a second adjacent leg and a second hypotenuse forming a third apex. An uppermost surface of the first, second and third triangle portions attach to the first end wall and a lowermost portion of the angled floor attaches the second end wall such that the angled floor slopes downwardly from the first end wall to the second end wall.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, wherein like structure is indicated with like reference numerals and in which:

DETAILED DESCRIPTION OF THE INVENTION

Figure 1:
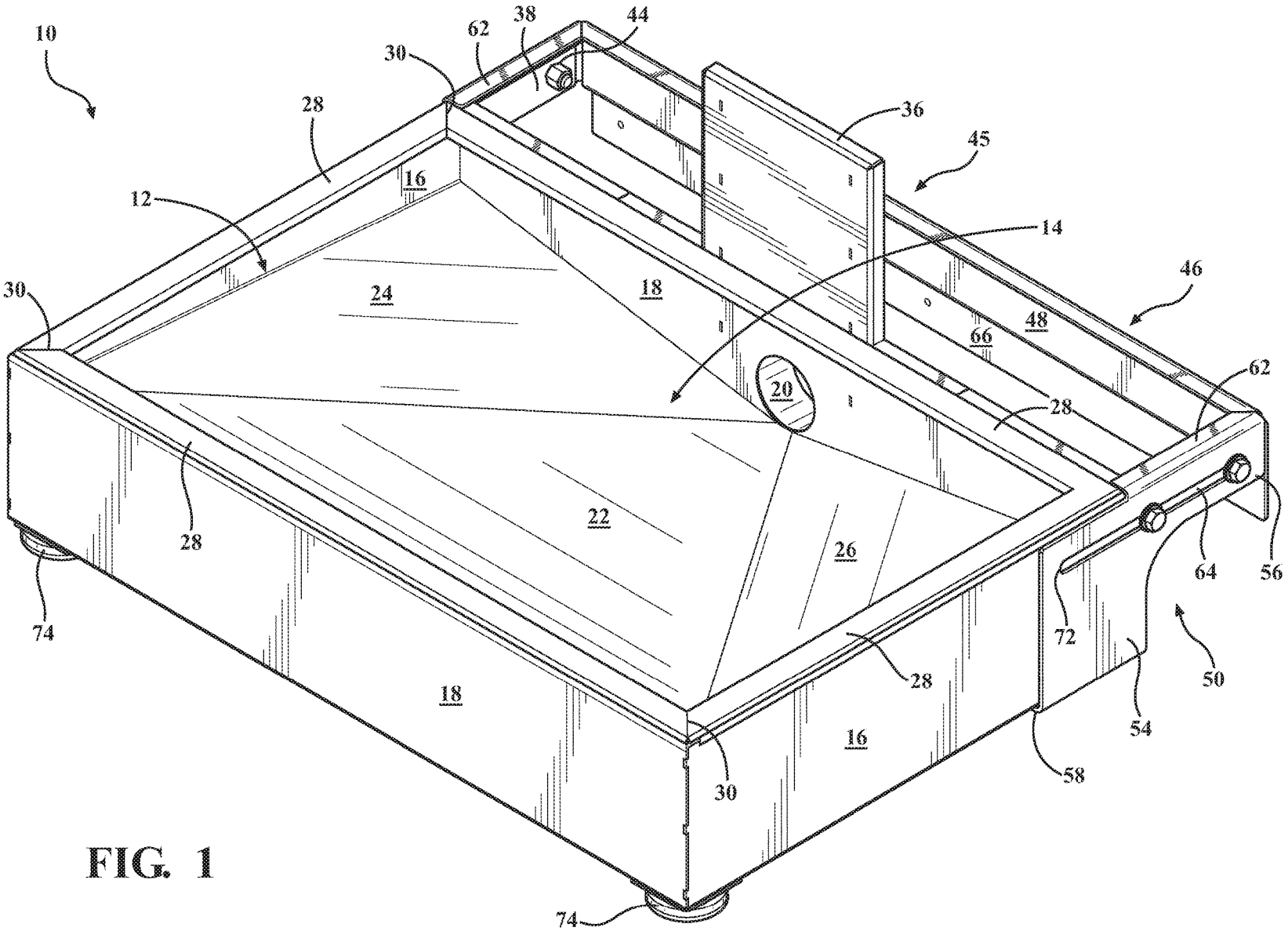
FIG. 1 schematically depicts a perspective view of a catch basin according to one or more embodiments described and illustrated herein.
Figure 2:
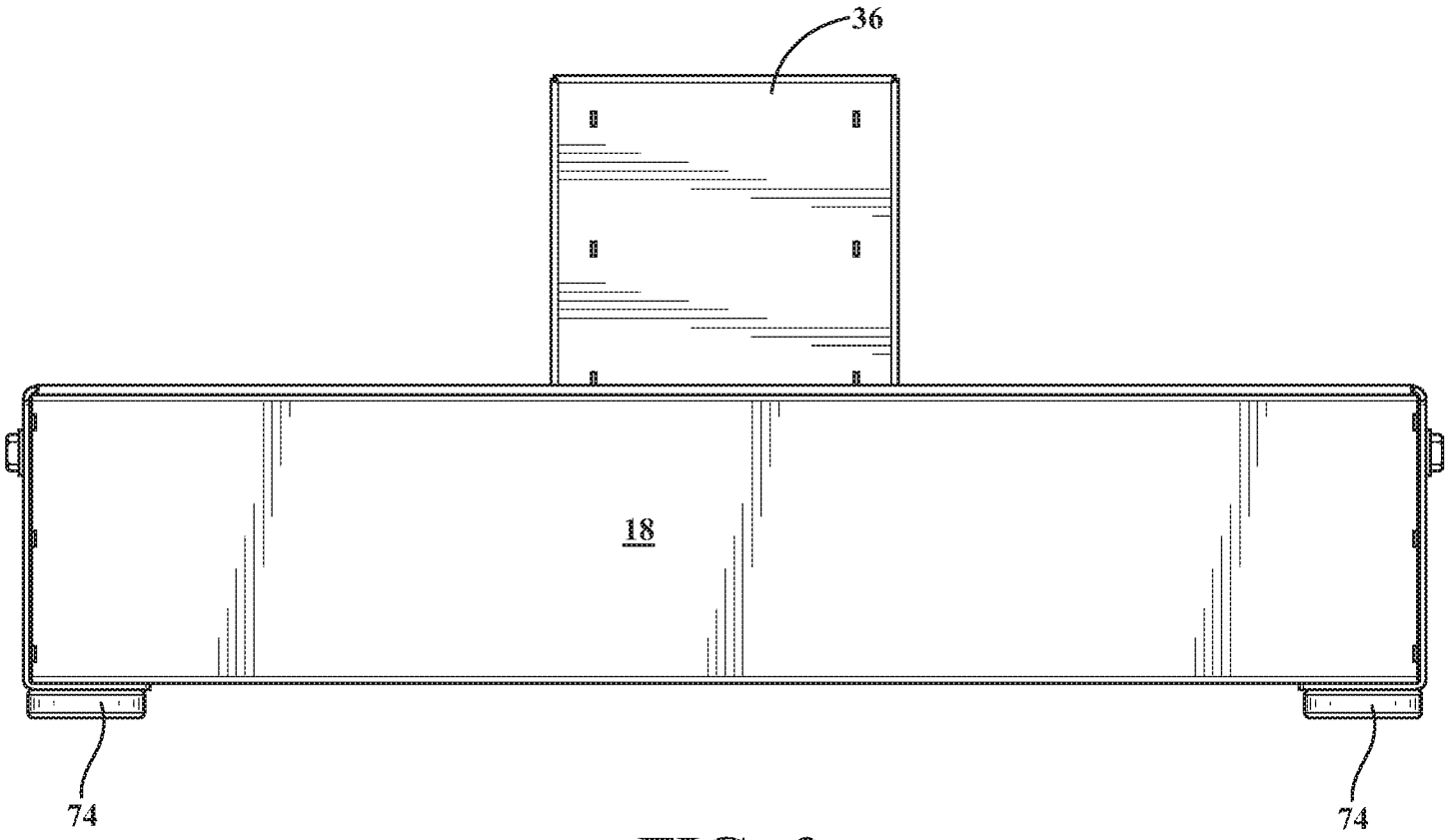
FIG. 2 schematically depicts a planar view including a front view of the catch basin according to one or more embodiments described and illustrated herein.
Figure 3:
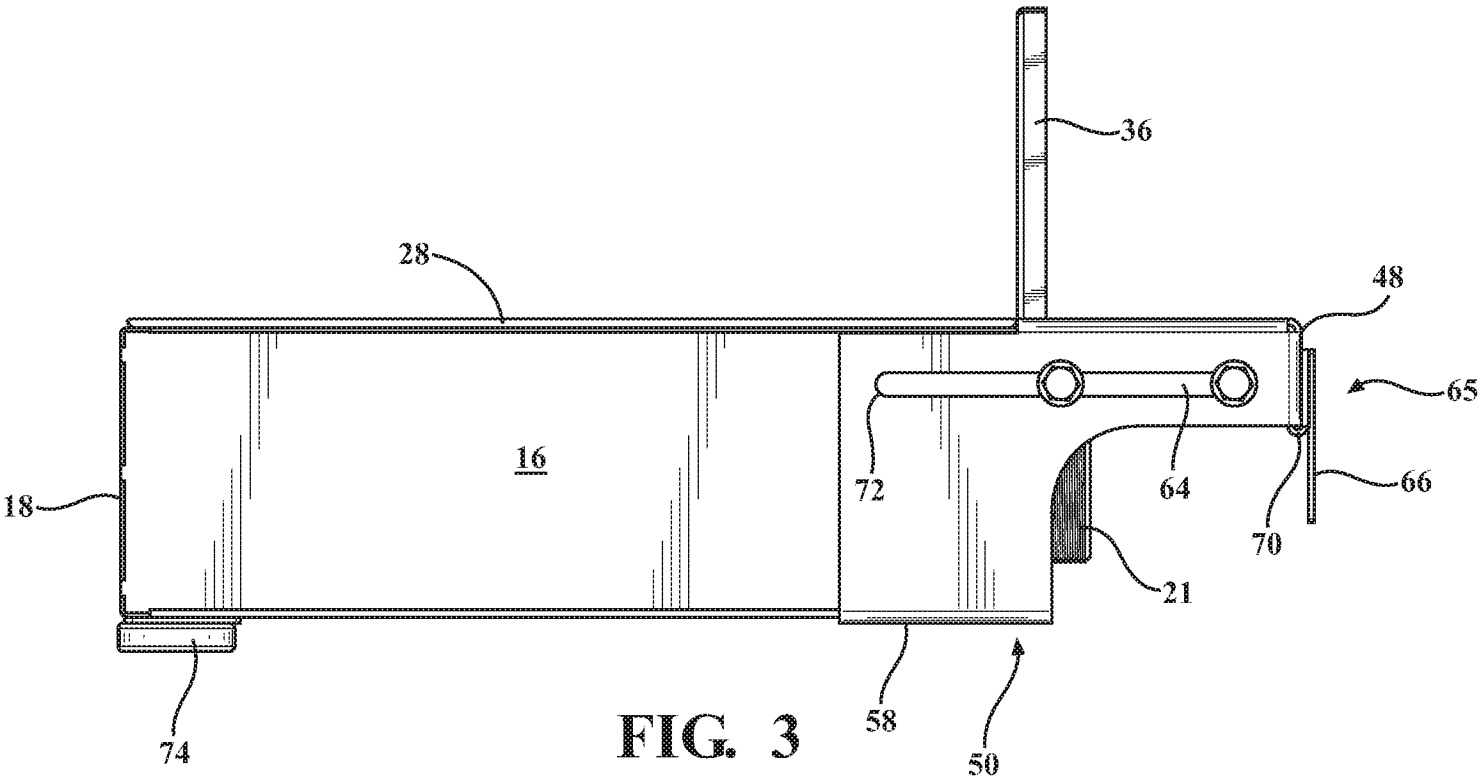
FIG. 3 schematically depicts a planar view of the side of the catch basin according to one or more embodiments described and illustrated herein.
Figure 4:
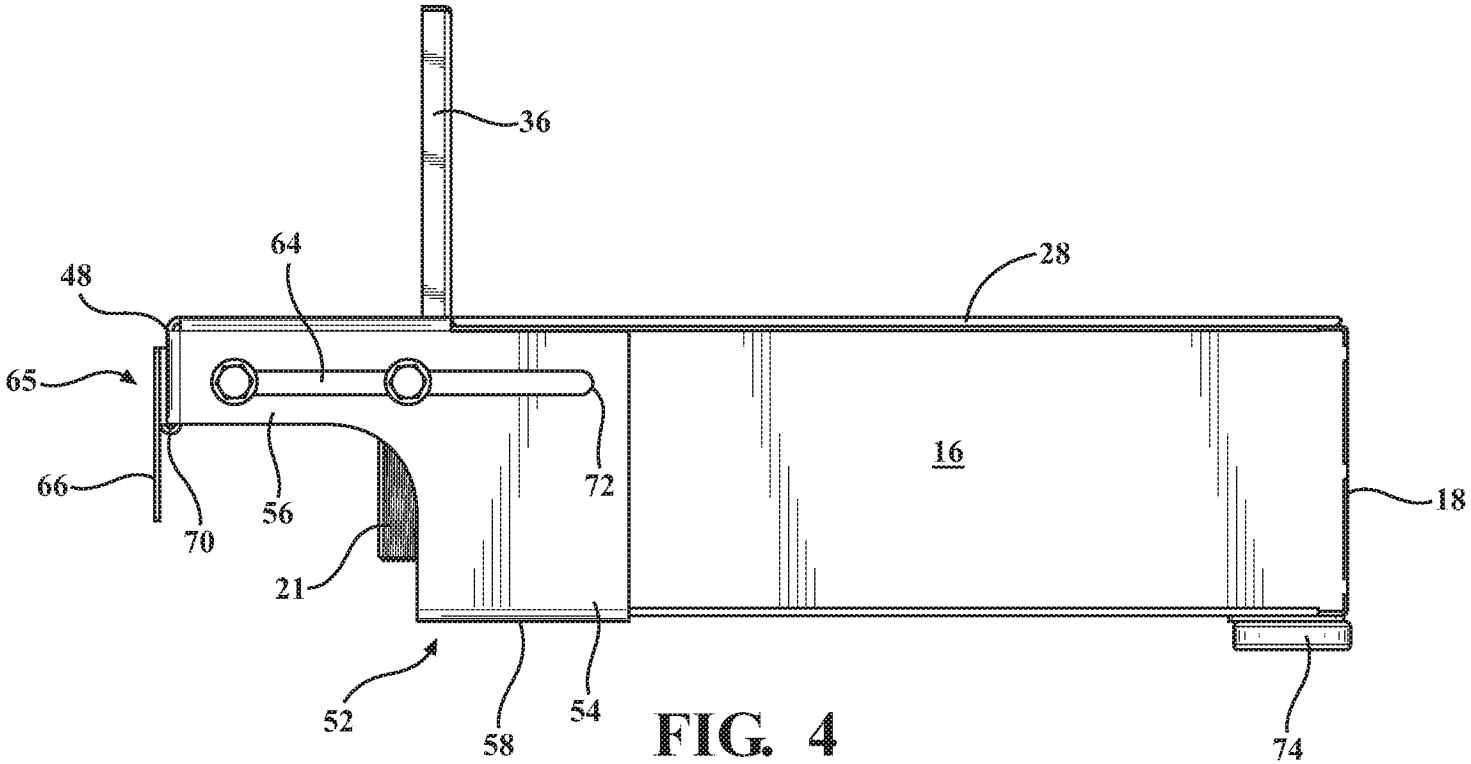
FIG. 4 schematically depicts a planar view of an opposite side of the catch basin according to one or more embodiments described and illustrated herein.
Figure 5:
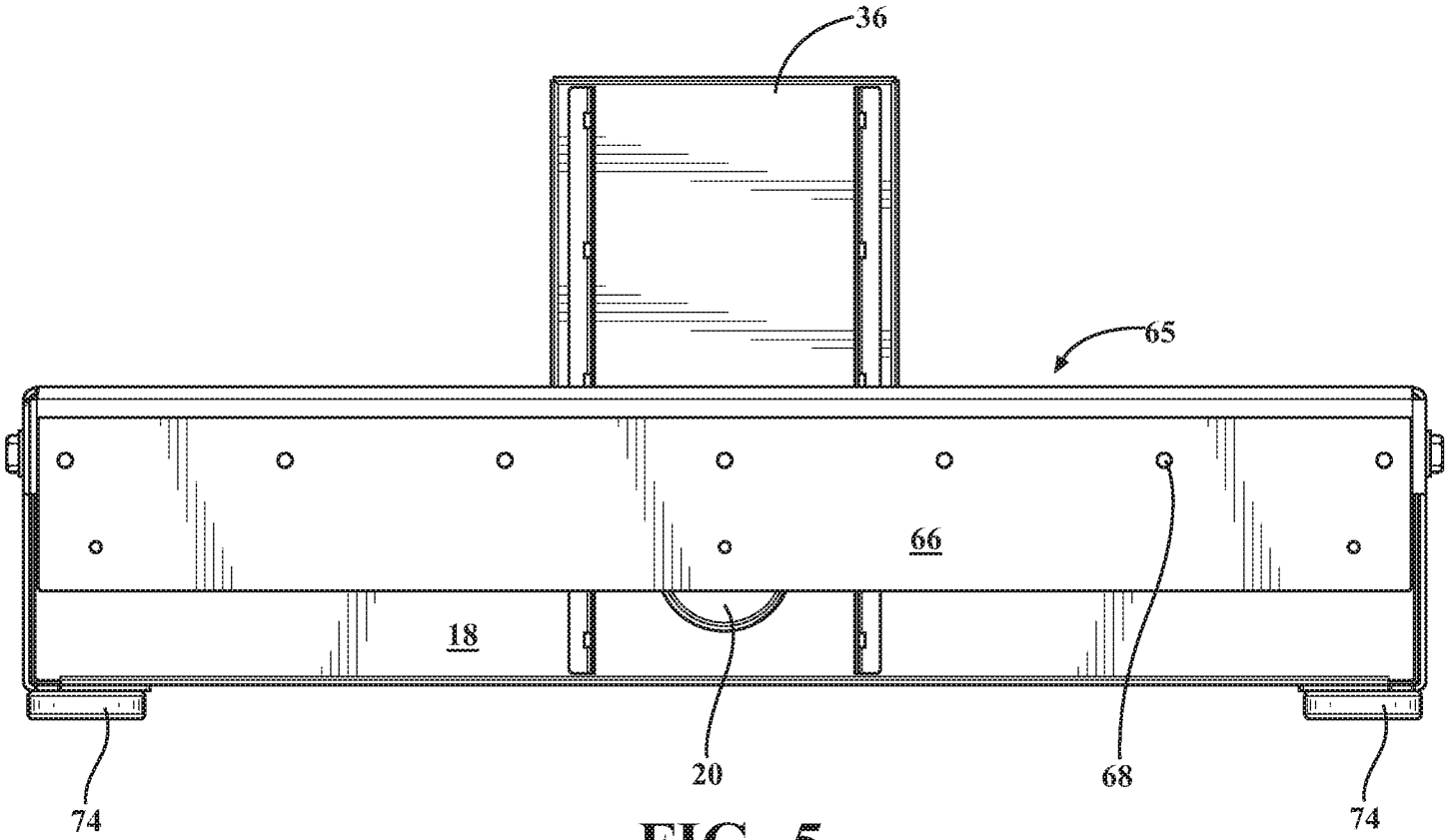
FIG. 5 schematically depicts a planar view of an opposite side of the catch basin according to one or more embodiments described and illustrated herein.
Figure 6:
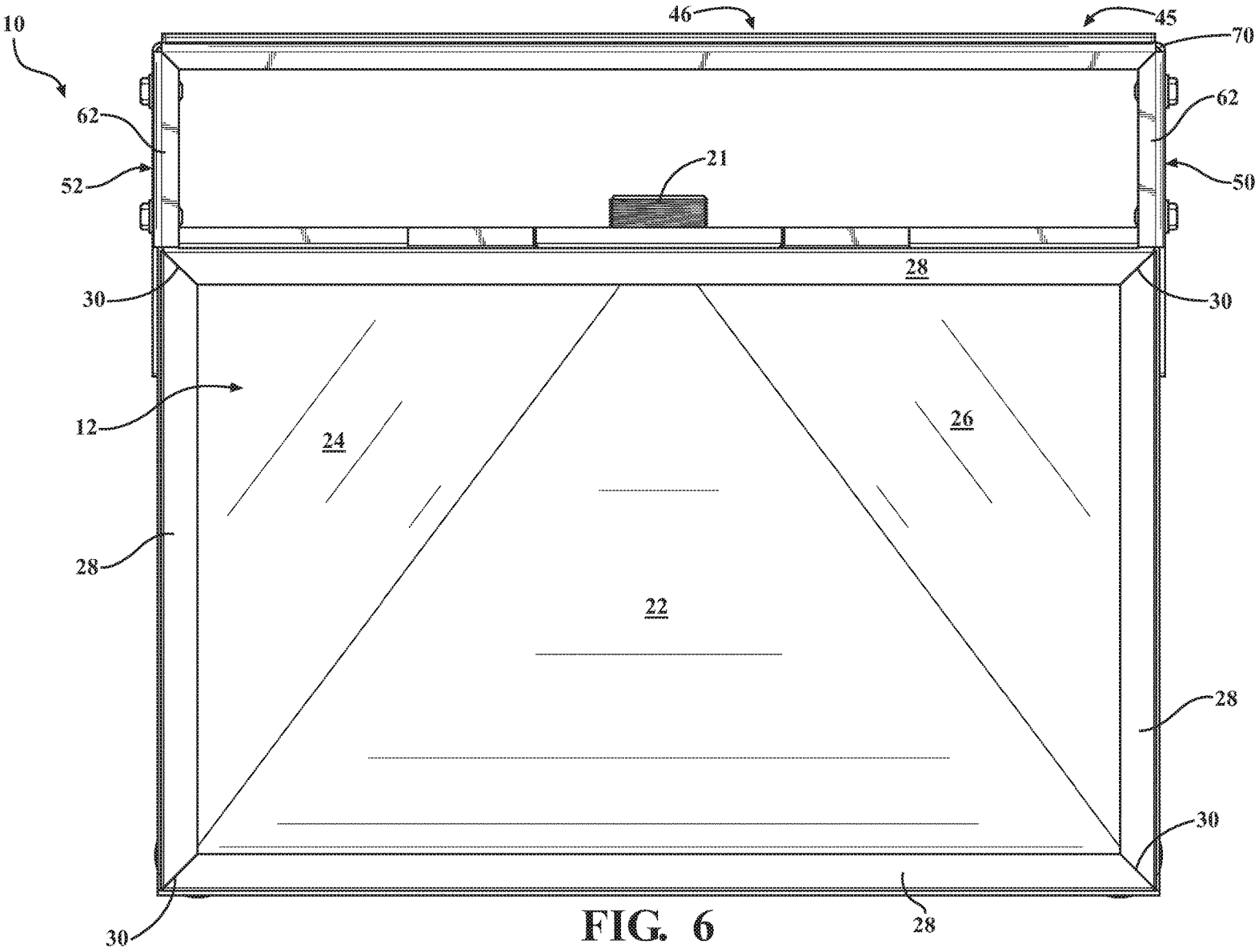
FIG. 6 schematically depicts a planar view of the top of the catch basin according to one or more embodiments described and illustrated herein.
Figure 7:
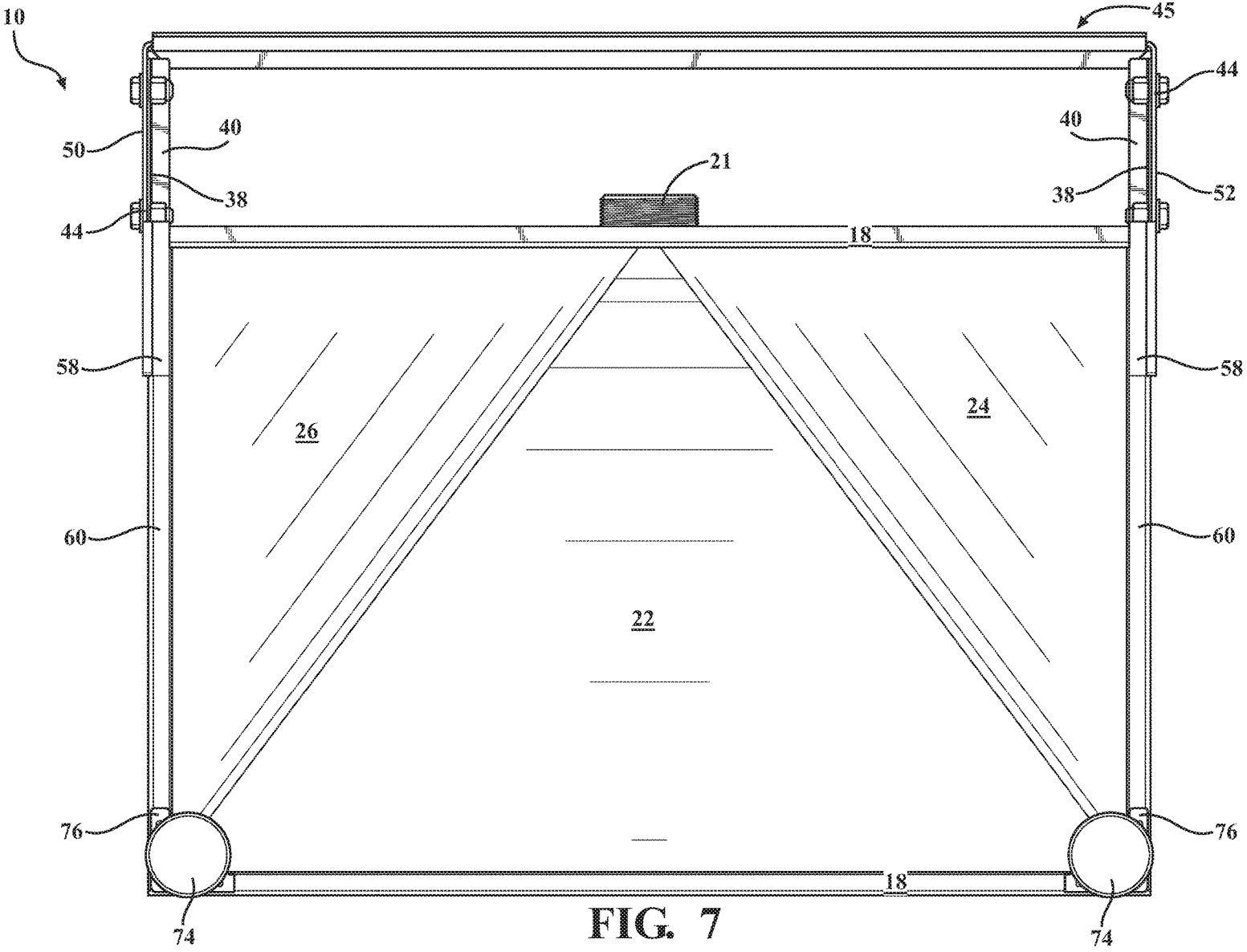
FIG. 7 schematically depicts a planar view of a bottom the catch basin according to one or more embodiments described and illustrated herein.

Embodiments of the present disclosure are directed to an assembly that drains liquid from kitchen equipment, in particular commercial kitchen equipment, where there otherwise is not a drain. More specifically, the disclosed system provides an assembly that can be mounted near the commercial kitchen equipment to drain liquids, such as water, from the equipment without the need to add in a floor drain. The assembly includes an angled floor within a reservoir to force the liquid through an aperture and a clip assembly so that the reservoir may be mounted directly to or near the kitchen equipment.

Referring to FIGS. 1-8, a catch basin 10 having a reservoir area 12 defined by an angled floor 14, a pair of sidewalls 16, and a pair of end walls 18 is shown. In this embodiment, the pair of sidewalls 16 have similar lengths and the pair of end walls 18 have similar lengths such that the reservoir area may be a rectangular shape The reservoir area 12 is open at a top surface so to permit access to the angled floor 14. Disposed within the end wall 18 is an aperture 20. The aperture 20 is configured remove a liquid from the reservoir area 12. It should be appreciated that in some embodiments, the aperture is a two inch hole configured to engage a two inch nipple 21. The angled floor 14 has three triangle portions.

A first triangle portion 22 has a base mounted to the end wall 18 with an apex at the center region of the aperture 20. The first triangle portion 22 is mounted between a second triangle portion 24 and a third triangle portion 26. A base of the second triangle portion 24 is mounted to the sidewall 16 and continues along the sidewall 16. An adjacent leg of the second triangle portion 24 extends from where the sidewall 16 and the end wall 18 meet and continues along the end wall 18 until an apex of the second triangle portion 24 is at the aperture 20. The hypotenuse of the second triangle portion 24 extends from the sidewall 16 to the apex at the aperture 20. A base of the third triangle portion 26 is mounted to the opposite sidewall 16 and continues along the opposite sidewall 16. An adjacent leg of the third triangle portion 26 extends from where the opposite sidewall 16 and the end wall 18 meet. The leg of the third triangle continues along the end wall 18 to an apex of the third triangle portion 26 at the aperture 20. The hypotenuse of the third triangle portion 26 extends from the opposite sidewall 16 to the apex at the aperture 20. The hypotenuse of the second triangle portion 24 and the third triangle portion 26 surround the two legs of the first triangle portion 22 so to form a continuous floor 14 between the pair of end walls 18 and pair of sidewalls 16. In one embodiment, the second triangle portion 24 and the third triangle portion 26 are right triangles. In another embodiment, the second and the third triangle portions 24, 26 are right isosceles triangles. Further, in one embodiment, the first triangle portion 22 is an equilateral triangle. In another embodiment, the first triangle portion 22 is an acute triangle.

An uppermost surface of the angled three triangle portions 22, 24, 26 are below an uppermost portion of the pair of sidewalls 16 and the pair of end walls 18. Further, a lowermost surface of the angled three triangle portions 22, 24, 26 are below the lowermost surface of the aperture 20. This angle assists in transferring fluids from the reservoir area 12 to the aperture 20 using gravity or other methods known to those skilled in the art.

A top surface of the pair of sidewalls 16 and the pair of end walls 18 have a lip portion 28 that is substantially planar so to provide a flat upper surface. The lip portion 28 extends from an outer surface of the sidewalls 16 and the end walls 18 to the reservoir area 12. The lip portion 28 includes four corners 30 that are complimentary angled so to align with the lip portion 28 of the wall 16, 18 it abuts. The lip portion 28 is configured to have a separate object, such as a frame 32 of a screen 34 (FIG. 8), abut the lip portion 28 while covering the reservoir area 12.

A backstop 36 extends from the upper surface of the end wall 18. The backstop 36 is a generally rectangular flat stock configured to engage with the a back wall of a commercial kitchen appliance, such as a rethermalizer (not illustrated) when the appliance is positioned over the catch basin 10, as described herein. The backstop 36 is generally mounted to the end wall 18 so to absorb the force of the appliance being slid into the backstop 36, as those skilled in the art would appreciate and understand.

Projecting rearward from the pair of sidewalls 16 is a pair of tabs 38. The pair of tabs 38 have an outer surface that transitions with the outer surface of the pair of sidewalls 16 so to keep a smooth outer surface between the tabs 38 and the sidewalls 16. Further, the pair of tabs 38 include a flange portion 40 that is sustainably planar. The flange portion 40 of the pair of tabs 38 has an upper surface area which aligns with the upper surface area of the pair of sidewalls 16 so to form a contiguous upper and outer surfaces. Further, the pair of tabs 38 do not extend the height of the pair of sidewalls 16. It should be appreciated that the pair of tabs 38 may include a rib that is attached to the end wall for support.

Each of the pair of tabs include two bores 44. Each of the bores 44 disposed on the pair of tabs 38 are complimentary axially aligned to the bore on the opposite tab so to permit alignment of a bracket 45. Each bore 44 is configured for a fastener, such as, without limitation, a bolt and nut.

The wall mount bracket has a generally U-shaped member 46 that slidably engages the tabs 38 and abuts the outer surface of the pair of sidewalls 16 and the upper surface of the pair of tabs 38. The U-shaped member 46 includes a rear portion 48 and a pair of generally L-shaped side members 50, 52. The L-shaped side members 50, 52 includes a base portion 54 and a stem portion 56. The base portion 54 further includes a first engagement member portion 58. The base portion 54 is configured to abut the outer surface of the pair of sidewalls 16 and the first engagement member portion 58 is configured to ride along a bottom surface of the pair of sidewalls 16.

The stem portion 56 extends between the base portion 54 and the rear portion 48. The stem portion 56 includes a second engagement portion 62 that is substantially planar. The second engagement portion 62 is configured to slide onto the upper surface area of the flange portion 40 of the pair of tabs 38 and ride along the flange portion 40. An elongated slot 64 extends between the base portion 54 and the stem portion 56 and is configured to slidably engage the bores 44 and the fasteners of the pair of tabs 38.

In some embodiments the rear portion 48 of the U-shaped member 46 may comprise of two components. For example, one component may be the rear portion 48 while the other component may be a clip 65. The clip 65 includes an elongated member 66 having a substantially planer portion parallel to the plane of the rear portion 48. In some embodiments, the elongated member 66 is a flat bar. The elongated member 66 includes a plurality of apertures 68 and a u-shaped slot 70 extending the length of the elongated member 66. The u-shaped slot 70 opens at a top surface of the elongated member 66 and is configured for the rear portion 48 to slidably engage within the u-shaped slot 70. The plurality of apertures 68 are configured for a fastener such as, without limitation, a bolt and nut, a screw, or any other fastener that one skilled in the art would know to use to mount the hanger clip to a wall, to a floor or to commercial kitchen equipment.

The U-shaped member 46 may be slidably adjusted along the flange portion 40 of the pair of tabs 38, regardless of whether the rear portion 48 is seated in u-shaped slot 70 of the elongated member 66. The U-shaped member 46 slides until a desired position is reached, or until an edge 72 of the elongated slot 64 makes contact with the fastener of the tabs 38. Thus preventing the U-shaped member 46 from further advancement. Moreover, when the U-shaped member 46 is positioned so that a portion of the base portion 54 of the L-shaped side members 50, 52 abuts the outer and bottom surface of the pair of sidewalls 16, so to provide additional support to the catch basin 10.

The bottom surface 60 of the sidewalls 16 and end walls 18 may include at least a pair of feet 74. The feet are generally mounted where the sidewall 16 abuts the end wall 18. The at least one pair of feet 74 are generally circular in shape and attach to a generally L-shaped mounting plate 76. It should be appreciated that the at least one pair of feet 74 are not limited to being circular and the L-shaped mounting plate 76 is not limited to being L-shaped.

Figure 8:
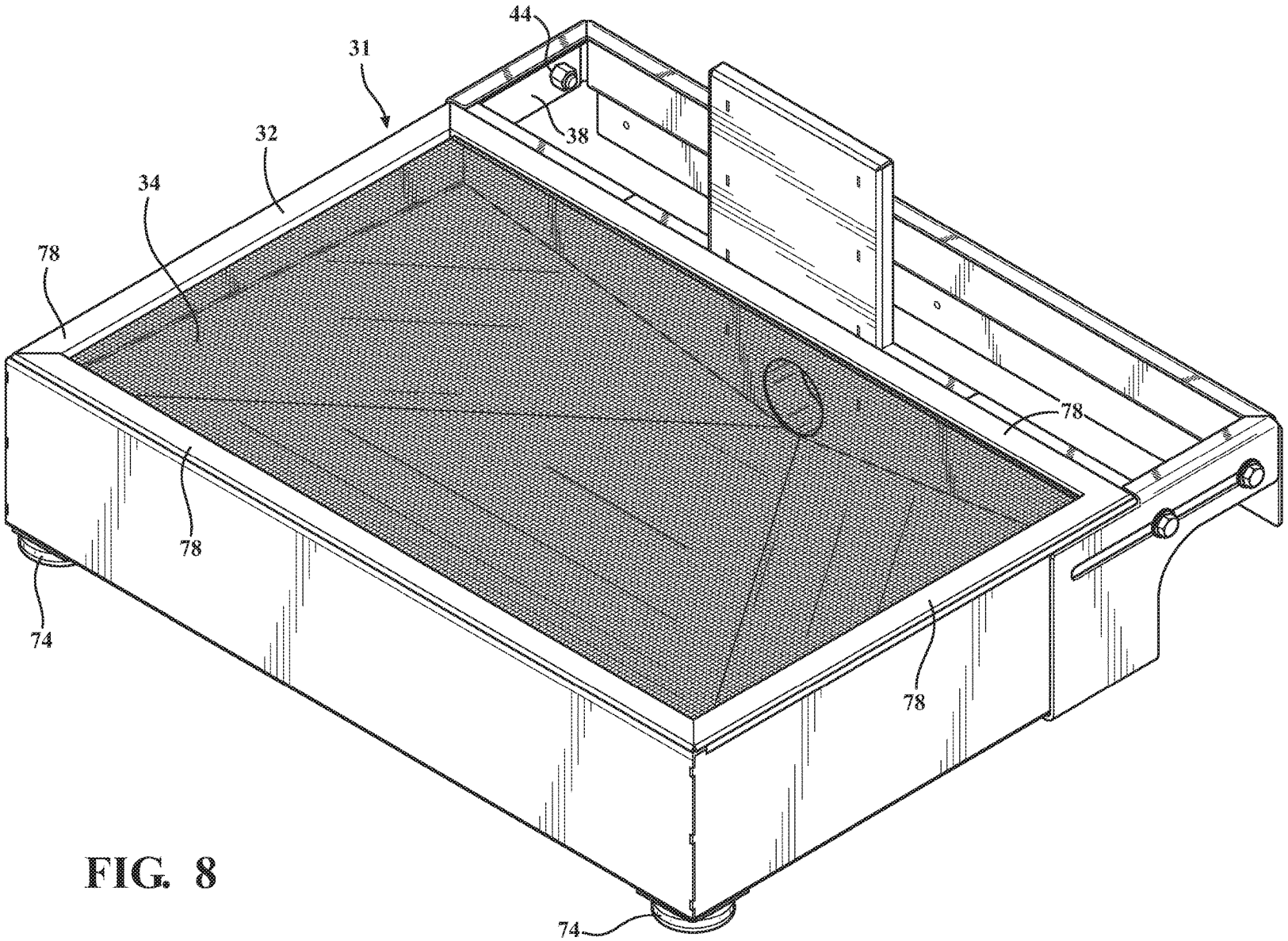
FIG. 8 schematically depicts a perspective view of the catch basin with a cover according to one or more embodiments described and illustrated herein.

Now referring to FIG. 8, the screen assembly 31 is illustrated. The screen assembly 31 includes the frame 32 and the screen 34. The frame 32 is planar and is configured to abut the flat upper surface of the lip portion 28 so to surround the reservoir area 12. It should be appreciated that the frame 32 and the screen 34 need not to abut the lip portion 28 of the reservoir area 12 and instead may be suspended above the lip portion 28 by any means including, without limitation, mounting the frame 32 top the backstop 36 in such a manner that one skilled in the art would appreciate. The screen 34 includes four end members 78 configured to attach to the screen 34. The screen 34 includes a plurality of holes and is configured to cover the reservoir area 12 so to prevent debris from entering the reservoir area 12 by filtering any fluids that enter the reservoir area 12 by the size and shape of the plurality of holes. It should be appreciated that the number of holes and the size and shape of the holes may vary by application and will be apparent to those skilled in the art. It should also be appreciated that the screen 34 is attached in such as manner as to below the frame 32 so that the screen is in a pinch fit engagement with the sidewalls 16 and end walls 18 below the lip portion 28.

The catch basin 10 may be positioned in a commercial kitchen under a ventilation hood, and near or beneath the rethermalizer or other commercial kitchen equipment requiring a fluid to be drained. The catch basin 10 is positioned on the centerline of the rethermalizer or other kitchen equipment and properly positioned under the ventilation hood so that the ventilation hood overlaps the catch basin 10 on all four sides. The bracket 45 is loosely fastened to a rear wall. The clip 65 is then temporarily attached to the loosely fastened wall mount bracket 45. Three mounting holes are marked and ¼ inch pilot holes are drilled through a tile base. If the rear wall does not have plywood behind the tile base, then a toggle bolt may need to be used. The clip 65 may be fastened by three #10×2½ inches stainless steel pan head screws.

Once mounted to the wall, the aperture of the catch basin is piped using CPVC piping or the like. A 2 inch nipple 21 is installed and other piping is attached so to form a continuous pipe from the aperture 20 to the existing floor drain. The pipe needs to be at a pitch from the aperture 20 to the floor drain and ran as close to the rear wall as possible, as those skilled in the art would appreciate.

Figure 9:
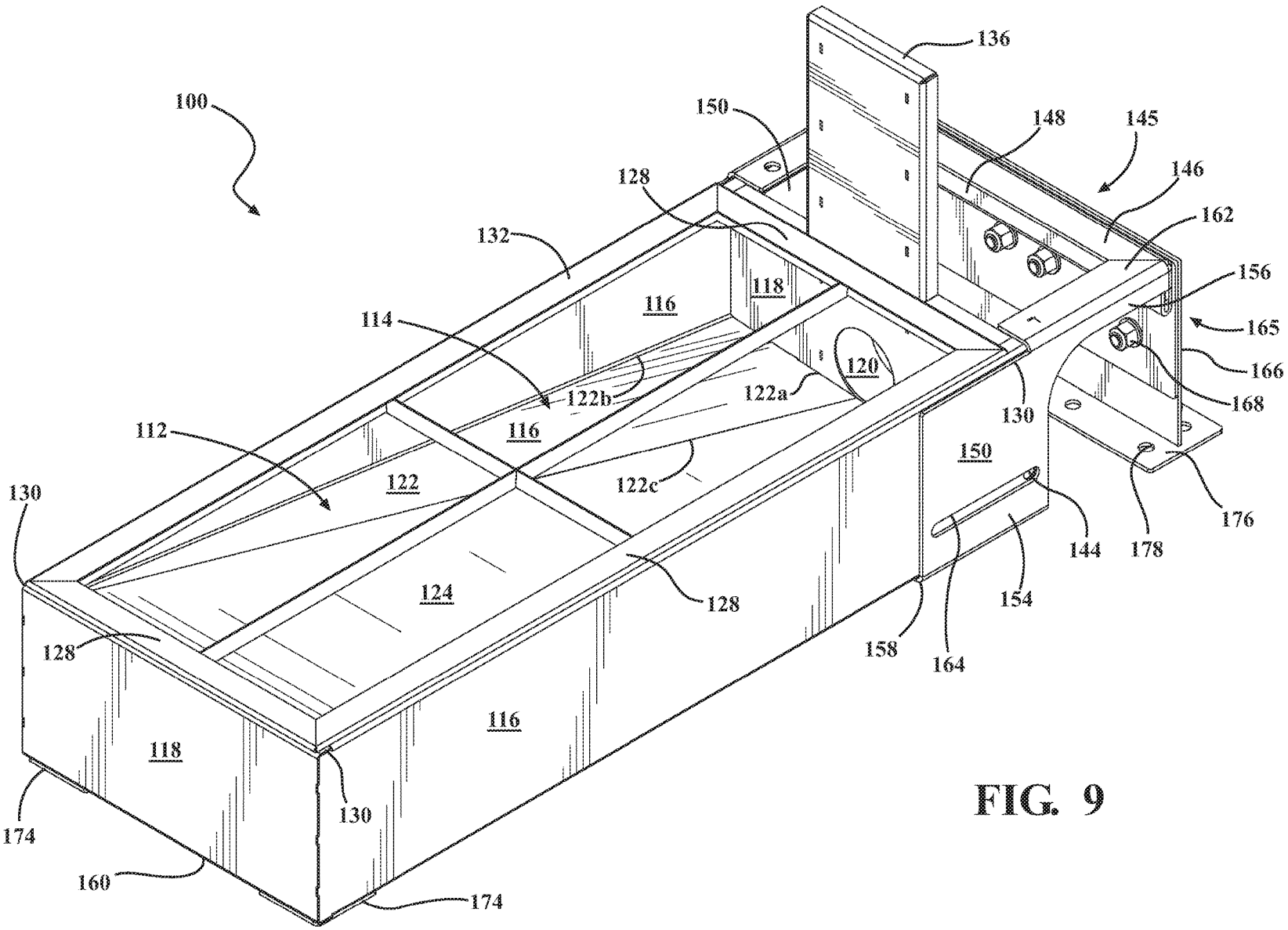
FIG. 9 schematically depicts a perspective view of a second embodiment of a catch basin according to one or more embodiments described and illustrated herein.

The catch basin 10 is adjusted on the bracket 45 by sliding the catch basin 10, with reference to the rear wall, into a position so to place the catch basin 10 as close to the rear wall as possible. The rethermalizer or other kitchen appliance is slid over the catch basin 10 until the rethermalizer or other kitchen appliance makes contact with the backstop 36 of the catch basin 10. The rethermalizer or other kitchen appliance is reconnected and activated Referring now to FIG. 9, a second embodiment of a catch basin 100 having a reservoir area 112 defined by an angled floor 114, a pair of sidewalls 116, and a pair of end walls 118 is schematically depicted. In this embodiment, the pair of sidewalls 116 have similar lengths and the pair of end walls 118 have similar lengths such that the reservoir area 112 may be a rectangular shape. It should be appreciated that the rectangular shape of the catch basin 100 is smaller when compared to the rectangular shape of the catch basin 10 (FIG. 1). The reservoir area 112 is open at a top surface so to permit access to the angled floor 114. Disposed within the end wall 118 is an aperture 120. The aperture 120 is configured remove a liquid from the reservoir area 112. It should be appreciated that in some embodiments, the aperture is a two inch hole configured to engage a nipple. The angled floor 114 has two triangle portions. As such, it should be appreciated that the rectangular shape of the catch basin 100 varies from the first embodiment.

A first triangle portion 122 has a first base portion 122*a*, a first adjacent leg 122*b* and a first hypotenuse 122*c*. The first base portion 122*a* is mounted to the end wall 118 with the first adjacent leg traveling the distance of the sidewall 116 and an apex of the first triangle portion 122 at the center region of the aperture 120. The first triangle portion 122 is mounted so to abut a second triangle portion 124. The second triangle portion 124 has a second base portion 124*a*, a second adjacent leg 124*b* and a second hypotenuse 124*c*. The second base portion 124*a* is mounted to the opposing end wall 118 with the second adjacent leg 124*b* traveling the distance of the opposing sidewall 116 and an apex of the second triangle portion 124 at the center region of the aperture 120. As such, the first hypotenuse 122*c* and the second hypotenuse 124*c* abut one another for the length of the first and second hypotenuse 122*c*, 124*c* so to form a continuous floor 114 between the pair of end walls 118 and pair of sidewalls 116. In one embodiment, the first triangle portion 122 and the second triangle portion 124 are right triangles. In another embodiment, the first and second triangle portions 122, 124 are right isosceles triangles.

An uppermost surface of the angled triangle portions 122, 124 are below an uppermost portion of the pair of sidewalls 116 and the pair of end walls 118. Further, a lowermost surface of the angled triangle portions 122, 124 are below the lowermost surface of the aperture 20. This angle assists in transferring fluids from the reservoir area 112 to the aperture 120 using gravity or other methods known to those skilled in the art.

A top surface of the pair of sidewalls 116 and the pair of end walls 118 may have a lip portion 128 that is substantially planar so to provide a flat upper surface. The lip portion 128 extends from an outer surface of the sidewalls 116 and the end walls 118 to the reservoir area 112. The lip portion 128 includes four corners 130 that are complimentary angled so to align with the lip portion 128 of the wall 116, 118 it abuts. The lip portion 128 is configured to have a separate object, such as a frame 132 that abuts the lip portion 128 while covering the reservoir area 112. The frame may include a screen. Further, each sidewall 116 may include a bore 144. Each bores 144 is complimentary axially aligned to the bore on the opposite sidewall 116 so to permit alignment of the bracket assembly 145. Each bore 144 is configured for a fastener, such as, without limitation, a bolt and nut, a screw, a rivet, and/or the like.

A backstop 136 extends from the upper surface of the end wall 118. The backstop 136 is a generally rectangular flat stock configured to engage with the a back wall of a commercial kitchen appliance, such as a rethermalizer (not illustrated) when the appliance is positioned over the catch basin 100, as described herein. The backstop 136 is generally mounted to the end wall 118 so to absorb the force of the appliance being slid into the backstop 136, as those skilled in the art would appreciate and understand.

Projecting rearward from the pair of sidewalls 116 may be a pair of tabs 138. The pair of tabs 138 have an outer surface that transitions with the outer surface of the pair of sidewalls 116 so to keep a smooth outer surface between the tabs 138 and the sidewalls 116. Further, the pair of tabs 138 may include a planar upper surface which aligns with the upper surface area of the pair of sidewalls 16 so to form a contiguous upper and outer surfaces.

A bracket assembly 145 has a generally U-shaped member 146 that slidably engages the tabs 138 and abuts the outer surface of the pair of sidewalls 116 and the upper surface of the pair of tabs 138. The U-shaped member 146 includes a rear portion 148 and a pair of generally L-shaped side members 150. The L-shaped side members 150 includes a base portion 154 and a stem portion 156. The base portion 154 further includes a first engagement member portion 158. The base portion 154 is configured to abut the outer surface of the pair of sidewalls 116 and the first engagement member portion 158 is configured to ride along a bottom surface of the pair of sidewalls 116. The base portion further includes an elongated slot 164 that extends a length of the base portion and is configured to slidably engage the bore 144 of the sidewall 116.

The stem portion 156 extends between the base portion 154 and the rear portion 148. The stem portion 156 includes a second engagement portion 162 that is substantially planar. The second engagement portion 162 is configured to slidably engage the upper surface area of the pair of tabs 38.

In some embodiments the rear portion 148 of the U-shaped member 146 may comprise of two components. For example, one component may be the rear portion 148 while the other component may be a mounting assembly 165. The mounting assembly 165 includes an elongated member 166, a u-shaped slot 170, and a foot member 176. The elongated member 166 is a substantially planer portion parallel to the plane of the rear portion 148. In some embodiments, the elongated member 166 is a flat bar. The elongated member 166 includes a plurality of apertures configured for a plurality of fasteners 168, such as bolts and nuts, screws, rivets, and/or the like, that may be used to attach the u-shaped slot 170 to the elongated member 166. As such, the u-shaped slot 170 may also include complimentary receiving apertures that align with the plurality of apertures of the elongated member 166. The u-shaped slot 170 extends the length of the elongated member 166. The u-shaped slot 170 opens at a top surface of the elongated member 166 and is configured for the rear portion 148 to slidably engage within the u-shaped slot 170. The foot member may include a plurality of bores 178 configured to fasten the elongated member 166 to a surface. Each bore 178 is configured for a fastener, such as, without limitation, a bolt and nut, a screw, a rivet, and/or the like.

The U-shaped member 146 may be slidably adjusted along the 138, regardless of whether the rear portion 148 is seated in the u-shaped slot 170 of the elongated member 166. Moreover, when the U-shaped member 146 is positioned so that a portion of the base portion 154 of the L-shaped members 150 abut the outer and bottom surface of the pair of sidewalls 116, so to provide additional support to the catch basin 100.

The bottom surface 160 of the sidewalls 116 and end walls 118 may include at least a pair of feet 174. The feet 174 are generally mounted where the sidewall 116 abuts the end wall 118.

The catch basin 100 may be positioned in a commercial kitchen under a ventilation hood, and near or beneath the rethermalizer or other commercial kitchen equipment requiring a fluid to be drained. The catch basin 100 may be positioned on the centerline of the rethermalizer or other kitchen equipment and properly positioned under the ventilation hood so that the ventilation hood overlaps the catch basin 100 on all four sides. The bracket assembly 145 is generally fastened to a floor surface or other surface below the desired position of the catch basin 100. The mounting assembly 165 may be temporarily attached to the bracket assembly 145. A nipple may be attached to the aperture 120 so to pipe or connect the aperture to a draining system.

It should be appreciated that the disclosed systems, methods, and computer program products are configured to identify one or more seminal cases within a database containing various text documents. More specifically, the disclosed systems, methods and computer program products provide an approach to identify one or more seminal cases and the legal issues that are addressed by a particular seminal case by mining a text database containing legal documents. Conventionally, seminal cases and their corresponding legal issues stored in a database are not marked or otherwise identified. This is because it is usually not known at the time of publication whether a case will eventually become particularly significant in a particular field of law. Moreover, the disclosed systems, methods, and computer program products transmit data to a search computer for the purposes of improving search results. Furthermore, the disclosed method employs a novel or unconventional approach to mine a text document database for one or more seminal cases and the corresponding issues that each case addresses.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A catch basin assembly, the assembly comprising:

a first sidewall and an opposing second sidewall;

a first end wall and an opposing second end wall are attached to the first and second sidewalls, the second end wall having an aperture disposed thereon;

an angled floor attached between the first and second sidewalls and the first and second end walls, the angled floor comprising a first triangle portion, a second triangle portion, and a third triangle portion, the first triangle portion comprising a first base, a first leg and a second leg forming a first apex, second triangle portion comprising a second base, a first adjacent leg and a first hypotenuse forming a second apex, and the third triangle portion comprising a third base, a second adjacent leg and a second hypotenuse forming a third apex, wherein:

an uppermost surface of the first, second and third triangle portions attach to the first end wall and a lowermost portion of the angled floor attaches the second end wall such that the angled floor slopes downwardly from the first end wall to the second end wall;

a pair of tabs extend from the second end wall in a direction opposite of the first end wall;

a bracket slidably engages the pair of tabs and is rearward of the second end wall, the bracket comprises a pair of L-shaped members attached to a rear portion, the pair of L-shaped members slidably engage the pair of tabs; and a clip comprising an elongated member having a u-shaped slot, the elongated member having a substantially planer surface parallel to a plane of the rear portion of the bracket, the u-shaped slot extends a length of the elongated member and is configured to receive the rear portion of the bracket.

2. The catch basin assembly of claim 1, wherein:

the first base of the first triangle portion is mounted to the second end wall such that the first apex abuts the aperture;

the second base of the second triangle portion is mounted to the first sidewall and the first adjacent leg is mounted to the second end wall such that the second apex abuts the aperture;

the third base of the third triangle portion is mounted to the second sidewall and the second adjacent leg is mounted to the second end wall such that the third apex abuts the aperture, wherein the first hypotenuse of the second triangle portion and the second hypotenuse of the third triangle portion surround the first leg and the second leg of the first triangle portion such that the angled floor is continuous.

3. The catch basin assembly of claim 1, wherein the first triangle portion is mounted between the second triangle portion and the third triangle portion.

4. The catch basin assembly of claim 1, wherein the second triangle portion and the third triangle portion are right triangles.

5. The catch basin assembly of claim 1, wherein the first triangle portion is an equilateral triangle.

6. The catch basin assembly of claim 1, wherein the elongated member of the clip comprises a plurality of bores configured for a plurality of fasteners such that the clip may be attached to a planner surface to suspended the catch basin assembly.

7. A catch basin assembly, the assembly comprising:

an angled floor;

a first and second sidewalls attached to the angled floor;

a first end wall and a second end wall is attached to the first and second sidewalls and the angled floor; and an aperture disposed in second end wall, wherein the angled floor slopes downwardly from the first end wall to the second end wall such that an upper most portion of the angled floor attaches to the first end wall and a lowermost portion of the angled floor attaches the second end wall and the lowermost portion of the angled floor abuts a lowermost portion of the aperture.

8. The catch basin assembly of claim 7, wherein the angled floor further comprises:

a first triangle portion comprising a first base, a first leg and a second leg forming a first apex;

a second triangle portion comprising a second base, a first adjacent leg and a first hypotenuse forming a second apex;

a third triangle portion comprising a third base, a second adjacent leg and a second hypotenuse forming a third apex, wherein an uppermost surface of the first, second and third triangle portions are below an uppermost portion of the first and second sidewalls and the first and second end walls.

9. The catch basin assembly of claim 8, wherein a lowermost surface of the first, second and third triangle portions abut with a centerline of the aperture.

10. The catch basin assembly of claim 9, wherein the first triangle portion is mounted between the second triangle portion and the third triangle portion.

11. The catch basin assembly of claim 10, wherein:

the first base of the first triangle portion is mounted to the second end wall such that the first apex abuts the aperture;

the second base of the second triangle portion is mounted to the first sidewall and the first adjacent leg is mounted to the second end wall such that the second apex abuts the aperture;

the third base of the third triangle portion is mounted to the second sidewall and the second adjacent leg is mounted to the second end wall such that the third apex abuts the aperture, wherein the first hypotenuse of the second triangle portion and the second hypotenuse of the third triangle portion surround the first leg and the second leg of the first triangle portion such that the angled floor is continuous.

12. The catch basin assembly of claim 8, wherein the second triangle portion and the third triangle portion are right triangles.

13. The catch basin assembly of claim 8, wherein the first triangle portion is an equilateral triangle.

14. A catch basin assembly, the assembly comprising:

a screen;

a first sidewall and an opposing second sidewall;

a first end wall and an opposing second end wall are attached to the first and second sidewalls, the second end wall having an aperture disposed thereon, wherein:

the first and second sidewalls and the first and second end walls have a planar top surface, the planer top surface is configured to receive the screen;

an angled floor attached between the first and second sidewalls and the first and second end walls, the angled floor comprising a first triangle portion, a second triangle portion, and a third triangle portion, the first triangle portion comprising a first base, a first leg and a second leg forming a first apex, second triangle portion comprising a second base, a first adjacent leg and a first hypotenuse forming a second apex, and the third triangle portion comprising a third base, a second adjacent leg and a second hypotenuse forming a third apex, wherein:

an uppermost surface of the first, second and third triangle portions attach to the first end wall and a lowermost portion of the angled floor attaches the second end wall such that the angled floor slopes downwardly from the first end wall to the second end wall.

15. The catch basin assembly of claim 14, further comprising:

a pair of tabs extend from the second end wall in a direction opposite of the first end wall;

a bracket slidably engages the pair of tabs and is rearward of the second end wall, the bracket comprises a pair of L-shaped members attached to a rear portion, the pair of L-shaped members slidably engage the pair of tabs; and a clip comprising an elongated member having a u-shaped slot, the elongated member having a substantially planer surface parallel to a plane of the rear portion of the bracket, the u-shaped slot extends the length of the elongated member and is configured to receive the rear portion of the bracket.

16. The catch basin assembly of claim 14, wherein:

the first base of the first triangle portion is mounted to the second end wall such that the first apex abuts the aperture;

the second base of the second triangle portion is mounted to the first sidewall and the first adjacent leg is mounted to the second end wall such that the second apex abuts the aperture;

the third base of the third triangle portion is mounted to the second sidewall and the second adjacent leg is mounted to the second end wall such that the third apex abuts the aperture, wherein the first hypotenuse of the second triangle portion and the second hypotenuse of the third triangle portion surround the first leg and the second leg of the first triangle portion such that the angled floor is continuous.

17. The catch basin assembly of claim 14, wherein the first triangle portion is mounted between the second triangle portion and the third triangle portion.

18. The catch basin assembly of claim 14, wherein the second triangle portion and the third triangle portion are right triangles.

19. The catch basin assembly of claim 14, wherein the first triangle portion is an equilateral triangle.

20. The catch basin assembly of claim 15, wherein the elongated member of the clip comprises a plurality of bores configured for a plurality of fasteners such that the clip may be attached to a planner surface to suspended the catch basin assembly.

* * * * *